US007571779B2

(12) United States Patent
Hedlund et al.

(10) Patent No.: US 7,571,779 B2
(45) Date of Patent: Aug. 11, 2009

(54) DRILL ROD AND METHOD OF MANUFACTURE THEREOF

(75) Inventors: Ann-Cathrin Hedlund, Sandviken (SE); Kenneth Larsson, Sandviken (SE)

(73) Assignee: Sandvik Intellectual Property Aktiebolag, Sandviken (SE)

( * ) Notice: Subject to any disclaimer, the term of this patent is extended or adjusted under 35 U.S.C. 154(b) by 531 days.

(21) Appl. No.: 11/087,799

(22) Filed: Mar. 24, 2005

(65) Prior Publication Data

US 2005/0217901 A1 Oct. 6, 2005

Related U.S. Application Data

(63) Continuation of application No. PCT/SE03/01476, filed on Sep. 22, 2003.

(30) Foreign Application Priority Data

Sep. 24, 2002 (SE) ..... 0202814

(51) Int. Cl.
*E21B 17/04* (2006.01)
*B21K 5/02* (2006.01)

(52) U.S. Cl. ..... 175/320; 76/108.2

(58) Field of Classification Search ..... 175/414, 175/320, 435; 285/288.1; 76/108.1, 108.2, 76/108.4

See application file for complete search history.

(56) References Cited

U.S. PATENT DOCUMENTS

| | | | | |
|---|---|---|---|---|
| 3,773,359 | A * | 11/1973 | Chance et al. | 285/288.1 |
| 3,784,238 | A * | 1/1974 | Chance et al. | 285/288.1 |
| 4,151,018 | A | 4/1979 | Bolton | |
| 4,625,814 | A * | 12/1986 | Helasuo et al. | 175/57 |
| 5,919,578 | A | 7/1999 | Lundell | |
| 5,988,301 | A | 11/1999 | Lundell | |
| 6,095,266 | A | 8/2000 | Lundell | |
| 7,182,159 | B2 * | 2/2007 | Linden | 175/320 |
| 2006/0118340 | A1 * | 6/2006 | Wahlstrom et al. | 175/320 |

FOREIGN PATENT DOCUMENTS

| | | | |
|---|---|---|---|
| GB | 2026044 A | * | 1/1980 |
| WO | WO 97/49520 | | 12/1997 |
| WO | WO 01/42615 | | 6/2001 |

* cited by examiner

*Primary Examiner*—Kenneth Thompson
(74) *Attorney, Agent, or Firm*—Drinker Biddle & Reath LLP

(57) ABSTRACT

A drill rod for percussive rock drilling includes a first rod part and an additional second rod part. The first rod part includes first and second ends, an inner duct, and an external thread disposed adjacent the first end, wherein the external thread is at least partly hardened by heat treatment. The additional rod part includes first and second ends, an inner duct, and an internally thread disposed adjacent the first end thereof, wherein the internal thread is at least partly hardened by heat treatment. The first ends of the respective first and second rod parts are threadedly secured to one another, and the second ends of the respective first and second rod parts are welded together to define a weld zone having a substantially martensitic structure. If there is further provided an intermediate hollow rod part, then the second ends of the respective first and second rod parts would be welded to respective ends of the intermediate hollow part to define weld zones having a substantially martensitic structure.

20 Claims, 4 Drawing Sheets

DRILL ROD AND METHOD OF MANUFACTURE THEREOF

This application is a Continuation of International Application Serial No. PCT/SE2003/001476 filed on Sep. 22, 2003, and which published in the English language by Publication No. WO 2004/029403 on Apr. 8, 2004.

TECHNICAL BACKGROUND

The present invention relates to a drill rod comprised of a plurality of threaded rod parts, and a method for manufacturing the drill rod.

PRIOR ART

In WO 01/42615 a friction welded drill rod of the above-mentioned type is disclosed. A disadvantage of the known rod is that the manufacture thereof is complicated and thereby expensive. The same can be said about the drill rods disclosed in U.S. Pat. No. 5,919,578, U.S. Pat. No. 5,988,301 and U.S. Pat. No. 6,095,266.

OBJECTS OF THE INVENTION

An object of the present Invention is to provide such a drill rod and manufacturing method which is uncomplicated and thereby cost efficient.

SUMMARY OF THE INVENTION

One aspect of the present invention involves a drill rod for percussive rock drilling, comprising a first rod part, and an additional rod part. The first rod part comprises first and second ends, an inner duct, and an external thread disposed adjacent the first end, wherein the external thread is at least partly hardened by heat treatment. The additional rod part comprises first and second ends, an inner duct, and an internally thread disposed adjacent the first end thereof, wherein the internal thread is at least partly hardened by heat treatment. The first ends of the respective first and second rod parts are threadedly secured to one another, and the second ends of the respective first and second rod parts are welded together to define a weld zone having a substantially martensitic structure.

In another aspect of the invention, there is further provided an intermediate hollow rod part. The first and second rod parts are threadedly secured to one another, and the second ends of the respective first and second rod parts are welded to respective ends of the intermediate hollow rod part to define weld zones having a substantially martensitic structure.

Other aspects of the invention relate to methods of manufacturing the above-described drill rods.

BRIEF DESCRIPTION OF THE DRAWINGS

The objects and advantages of the invention will become apparent from the following detailed description of a preferred embodiment thereof in connection with the accompanying drawing in which like numerals designate like elements, and in which.

DETAILED DESCRIPTION OF A PREFERRED EMBODIMENT

Figure 1:
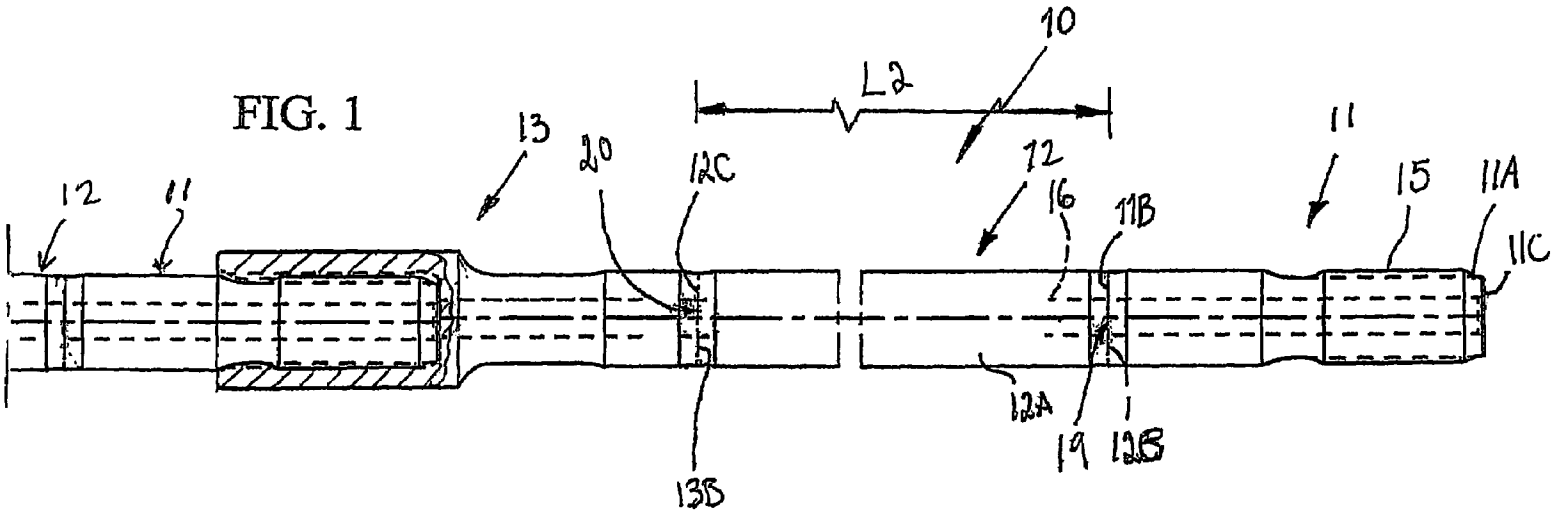
FIG. 1 shows a drill rod comprised of a plurality of drill rod parts according to the present invention in side view.

In FIG. 1, a drill rod 10 is shown comprising a first rod part 11, a second rod part 12 and a third rod part 13. Said parts are at least partly cylindrical. The drill rod 10 has a through-going duct for transportation of flushing medium such as water, air or a mixture of the same.

Figure 2:
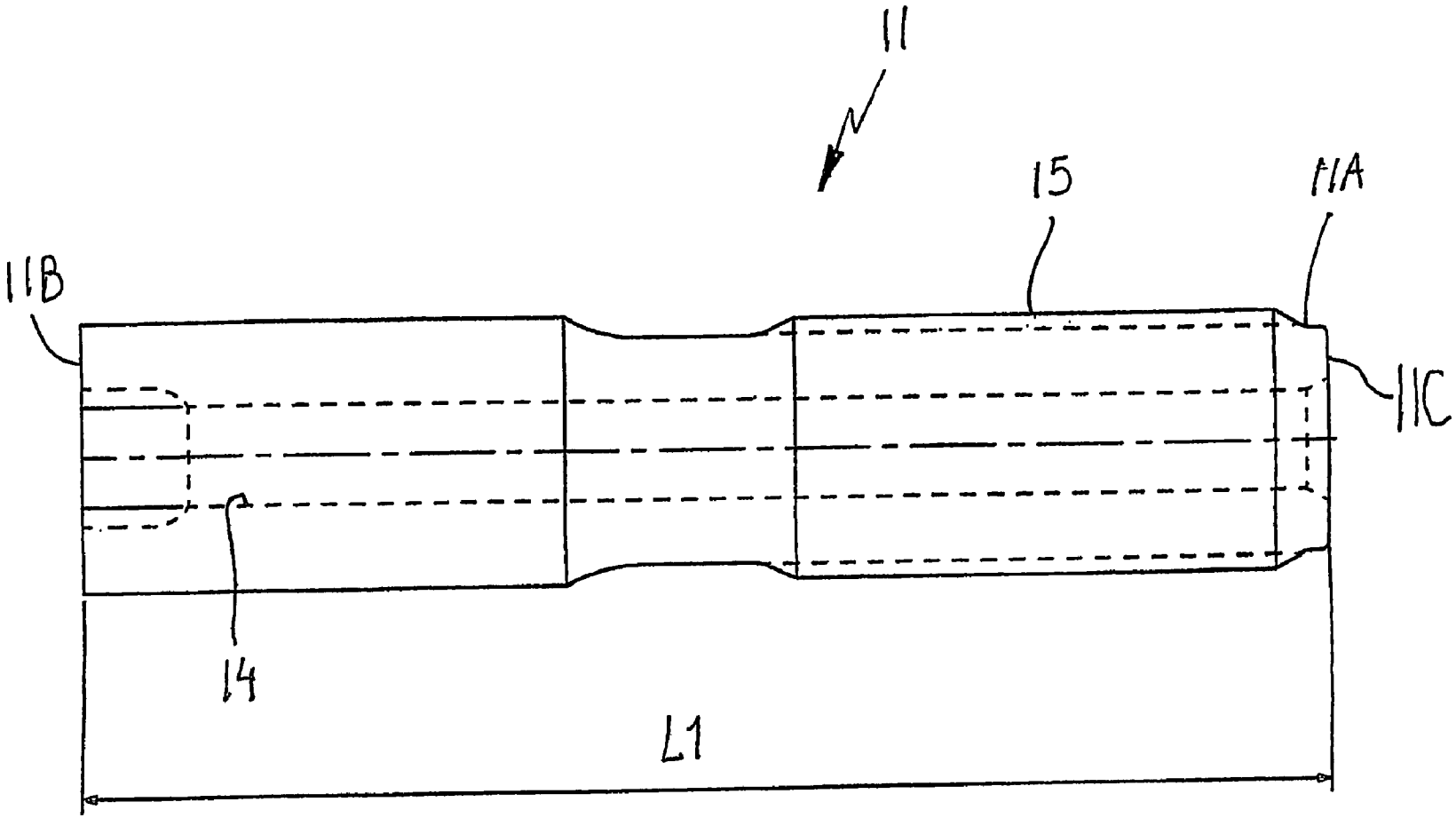
FIG. 2 shows a drill rod part before welding.
Figure 3:
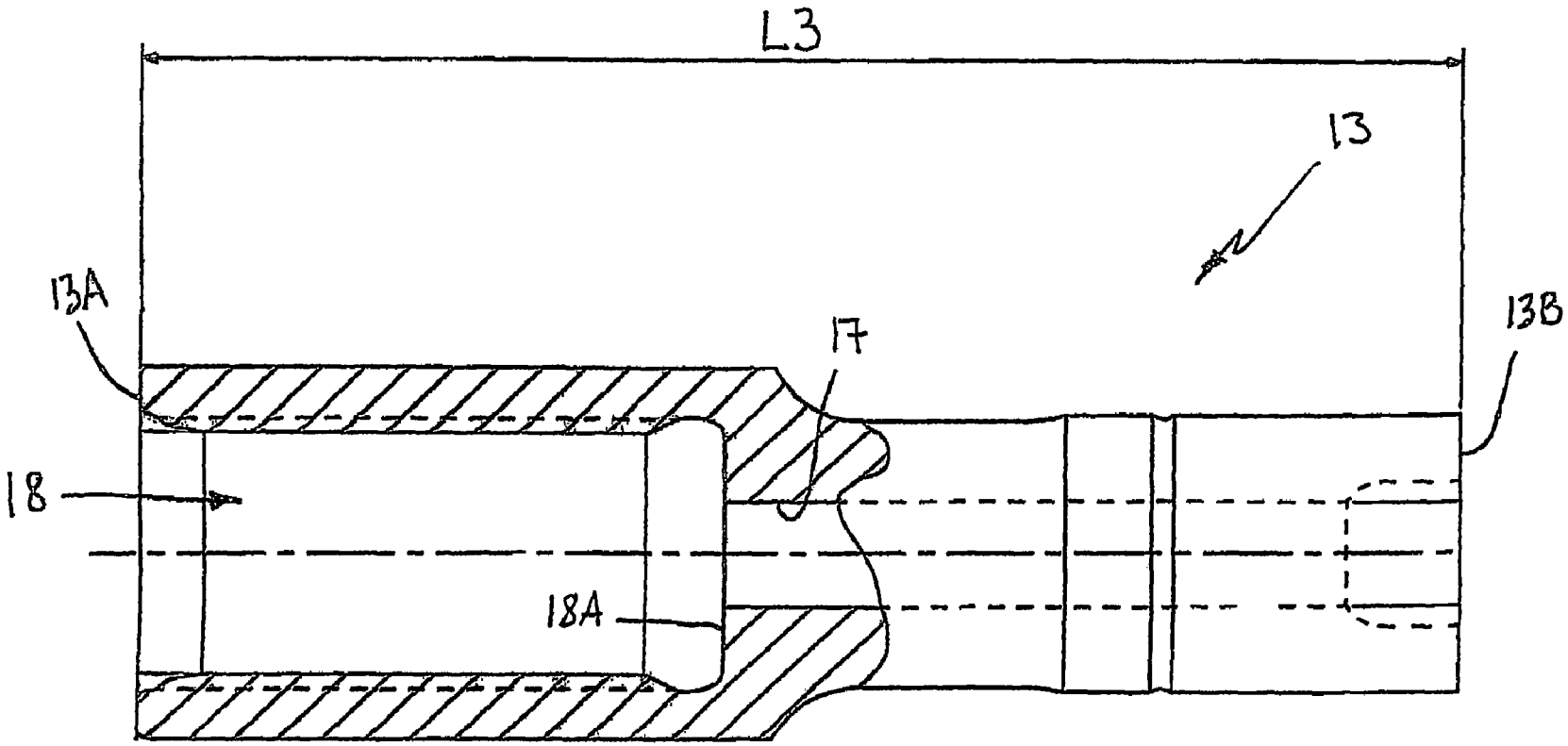
FIG. 3 shows another drill rod part, partly in cross-section, before welding.

The first rod part 11 according to FIG. 2 comprises a free end 11A, an opposite end 1B, an inner duct 14, and an externally threaded part 15 near the free end. The free end has a stop face 11C for transfer of shock waves. The externally threaded part 15 is entirely or partly hardened by heat treatment. The first rod part 11 has a largest length L1, which is 0.2-0.5 m. In a preferred embodiment, the length L1 is 0.27 m. The externally threaded part 15 is hardened to a hardness In the interval of 440 HVI to 750 HVI. The first rod part 11 is preferably tempered and high-frequency hardened before welding to another part.

The second rod part 12 consists of a round rod 12A having an inner duct 16, see FIG. 1. The rod part 12 has end surfaces 12B and 12C, each one of which has an outer diameter substantially equal to that of the opposite end 11B of the first rod part 11. The second rod part 12 has a largest length L2, which is in the range of 1-5 m. In a preferred embodiment, the length L2 is 3.8 m. The second rod part 12 does not need to be heat-treated before welding to another part. The steel from which the second rod part is manufactured has a core hardness that is in the Interval of 350 HVI to 440 HVI.

Figure 1A:
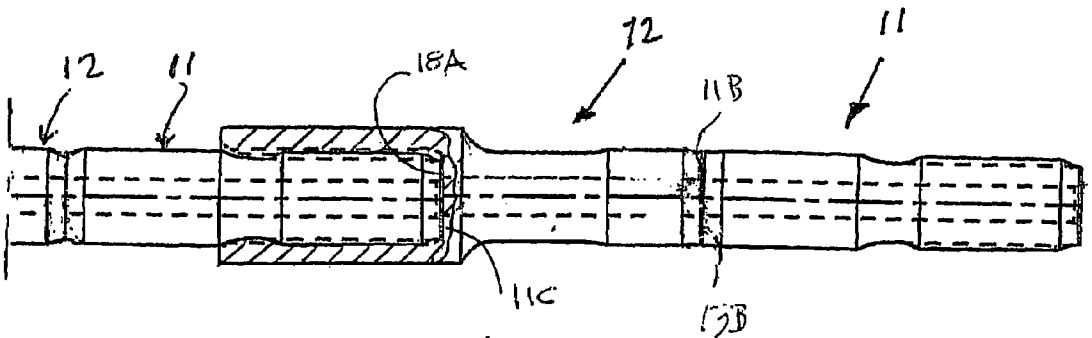
FIG. 1A shows a modified form of drill rod according to the invention, in side view.

The third rod part 13 comprises a free end 13A, an opposite end 13B, an Inner duct 17, and an internally threaded recess or part 18 associated to the inner duct of the second rod part near the free end 13A. The internally threaded part 18 is entirely or partly hardened by heat treatment, i.e., the heat treatment can extend through all, or only a part of, the thickness of the threaded part 18. The third rod part 13 has a largest length L3, which is 0.2-0.5 m. In a preferred embodiment, the length L3 is equal to the length L1, for instance 0.27 m. The recess 18 has a bottom surface 18A intended to co-operate with a stop face 11C of an associated second drill rod (see FIG. 1A) in order to transfer shock waves during percussive rock drilling. The Internally threaded part is hardened to hardness in the Interval of 440 HV1 to 750 HV1. The third rod part 13 is heat-treated preferably by acierage and direct hardening by means of air-cooling before welding to another part.

The opposite ends 11B and 13B of the rod parts 11 and 13, respectively, are friction welded together to each other (FIG. 1A) or to the second rod part 12 (FIG. 1) in a conventional way in order to define weld zones or melting lines 19 and 20 at the respective opposite ends 11B and 13B. The weld zones have not been heat-treated, for example annealed, after welding. Each weld zone 19, 20 has at least partly higher hardness value than the core hardness of the steel from which the second rod part 12 is manufactured. The readily usable rod comprises soft zones at each side of the weld zone 19, 20. The hardness of the soft zone is more than 300 HV1 but less than 360 HV1 at each side of the weld zone 19, 20. The drill rod comprises two welds, spaced-apart from each other in the axial direction of the rod with a distance of 1-5 m. The largest length L of the completed drill rod is in the interval of 3-10 m, preferably around 4.5 m.

Figure 4:
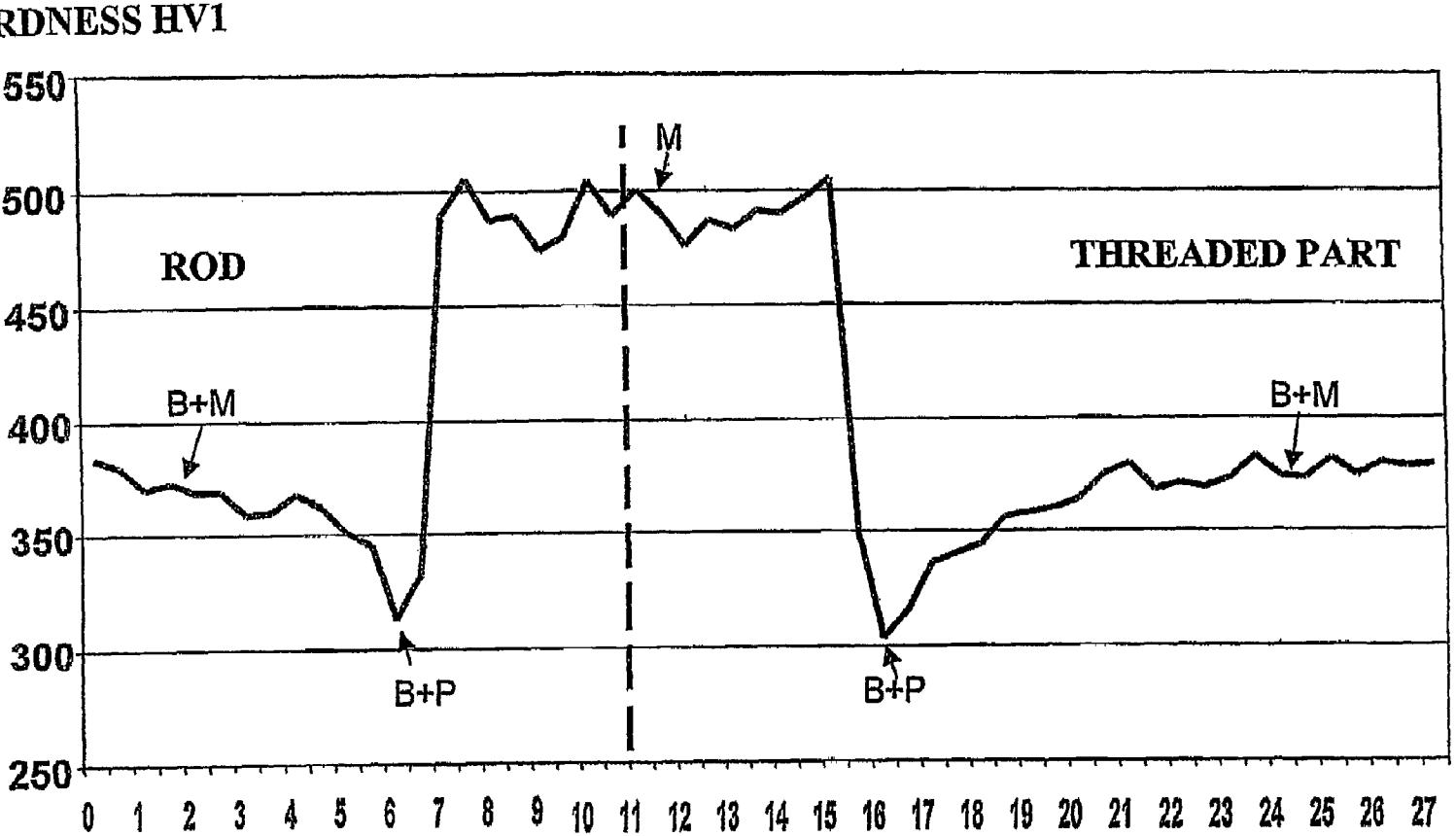
FIG. 4 shows a chart regarding core hardness distribution in the longitudinal direction of a drill rod according to the present invention around the melting line.

FIG. 4 shows a chart regarding core hardness distribution in the longitudinal direction of a drill rod according to the present invention around the melting line. HV1 is Vicker's hardness with a load of 1 kg. We have surprisingly found that it is possible to use the drill rod 10 directly after friction welding without subsequent heat treatment.

At friction welding, soft zones arise around the melting line. The melting line may be defined as the bonding zone between two components and is shown by means of a vertical dashed line in FIG. 4. The melting line may be regarded as having a width of 0.3-3.0 mm. The weld zone includes the melting line and is preferably 7-11 mm in the axial direction. The core hardness profile is shown by means of an unbroken line and the hardness increases significantly from the starting material in the direction of the melting line. In the chart, the structure that the respective part has after the friction welding is given. The rod 12 is only rolled and contains about 50% bainite B and about 50% martensite M. The threaded part or the rod part II or 13 is preferably tempered but the opposite end thereof consists of about 50% bainite and about 50% martensite. On both sides (about 4 mm) of the melting line, the weld zone 19,20 has essentially (more than 50%) non-annealed, martensite structure and high hardness (just below 500 HV1). Axially next to the non-annealed, martensitic structure, there is a structure essentially consisting of bainite and perlite P. The later structure has a relatively low hardness around 320 HV1. In spite of this large difference in hardness, the drill rod 10 according to the present invention has at tests turned out to obtain production results equivalent to those of heat-treated conventional drill rods.

The method for manufacturing the drill rod comprises the following steps: provide a first rod part 11 with an inner duct 14, a free end 11A, an opposite end 11B and an externally threaded part 18 near the free end, the externally threaded part entirely or partly being hardened by heat treatment; provide an additional rod part 13 having an inner duct 17, a free end 13A, an opposite end 13B, and an internally threaded part 18 associated to the inner duct of the additional rod part, the internally threaded part entirely or partly being hardened by heat treatment; wherein the opposite ends of the rod parts are welded together (FIG. 1A) in order to define a weld zone next to the opposite ends, the resulting drill rod 10A being intended to be used without the weld zone having been heat-treated after welding. Preferably, each of the rod parts 11 is friction welded to a hollow rod part 12 (FIG. 1) in order to form a drill rod 10. Preferably, each weld zone is then turned in a machining operation, so that the radially outer surface of the weld zone becomes smooth and somewhat concave. The drill rod is welded preferably at two points, spaced-apart from each other by at least one metre in the axial direction of the rod. The drill rod is made from steel having a certain core hardness. The weld zone is given the same hardness value as, or higher hardness value than, the core hardness of the steel in the hollow rod part. The externally threaded part and the internally threaded part are hardened to hardness In the Interval of 440 HV1 to 750 HV1.

With the objects of uncomplicated and cost effective production the rod is preferably manufactured from at least three separate, readily machined parts, thus there are at least two weld zones after friction welding. By having an intermediate storage of those separate parts they can be combined in different ways to provide prerequisites for a quick and flexible production of different shapes of rods. Thus, the size of the stock of readily usable rods can be reduced and thereby reducing the costs for storage and the risk for obsolete products.

Although the present invention has been described in connection with preferred embodiments thereof, it will be appreciated by those skilled in the art that additions, modifications, substitutions and deletions not specifically described may be made without departing from the spirit and scope of the invention as defined in the claims.

What is claimed is:

1. A drill rod for percussive rock drilling comprising:

a first rod part comprising first and second ends, an inner duct, and an external thread disposed adjacent the first end, wherein the external thread is at least partly hardened by heat treatment; and a second rod part comprising first and second ends, an inner duct, and an internal thread disposed adjacent the first end thereof, wherein the internal thread is at least partly hardened by heat treatment, wherein the second end of the first rod part and the second end of the second rod part are welded together to define a weld zone having a substantially martensitic structure, and wherein the hardening of the external and internal threads is performed to achieve a hardness in the range of 440 to 750 HV1.

2. The drill rod according to claim 1 wherein axially successive weld zones are spaced apart by at least one meter.

3. The drill rod according to claim 1 wherein the weld zone includes a friction weld.

4. A method for the manufacture of a drill rod for percussive rock drilling, comprising the steps of:

A) providing a first rod part having first and second ends, an inner duct, and an external thread disposed adjacent the first end, wherein the external thread is at least partly hardened by heat treatment;

B) providing a second rod part having first and second ends, an inner duct, and an internal thread disposed adjacent the first end thereof, wherein the internal thread is at least partly hardened by heat treatment; and C) welding together the second ends of the first rod part and the second rod part to define a weld zone having a substantially martensitic structure and to provide a drill rod ready for use, wherein the weld zone has a higher hardness value than a core hardness of the first and second rod parts, the internal and external threads being hardened to a value in the range of 440 to 750 HV1.

5. The method according to claim 4 further including a plurality of additional weld zones, wherein axially successive weld zones are spaced apart by at least one meter.

6. The method according to claim 4 wherein the weld zones are not heat treated after welding.

7. A drill rod for percussive rock drilling comprising:

a first rod part comprising first and second ends, an inner duct, and an external thread disposed adjacent the first end, wherein the external thread is at least partly hardened by heat treatment; and a second rod part comprising first and second ends, an inner duct, and an internal thread disposed adjacent the first end thereof, wherein the internal thread is at least partly hardened by heat treatment; and at least one intermediate hollow rod part;

wherein the second ends of the first and second rod parts are welded to respective ends of the intermediate hollow rod parts to define weld zones having a substantially martensitic structure, and wherein the hardening of the external and internal threads is performed to achieve a hardness in the range of 440 to 750 HV1.

8. The drill rod according to claim 7 wherein axially successive weld zones are spaced apart by at least one meter.

9. The drill rod according to claim 7 wherein the weld zone includes a friction weld.

10. A method for the manufacture of a drill rod for percussive rock drilling, comprising the steps of:

A) providing a first rod part having first and second ends, an inner duct, and an external thread disposed adjacent the first end, wherein the external thread is at least partly hardened by heat treatment;

B) providing a second rod part having first and second ends, an inner duct, and an internal thread disposed adjacent the first end thereof, wherein the internal thread is at least partly hardened by heat treatment;

C) providing at least one intermediate rod part; and

D) welding the second ends of the respective first and second rod parts to respective ends of intermediate rod parts to define weld zones having a substantially martensitic structure, wherein each weld zone has a higher hardness value than a core hardness of the first and second rod parts; the internal and external threads being hardened to a value in the range of 440 to 750 HV1.

11. The method according to claim 10 wherein axially successive weld zones are spaced apart by at least one meter.

12. The method according to claim 10 wherein the joined first rod part, second rod part and at least one intermediate part form a first drill rod, and the method further includes joining a plurality of additional first, second and intermediate rod parts welded together with additional weld zones to form additional drill rods and threadedly joining at least two drill rods to form a drill string, wherein axially successive weld zones are spaced apart by at least one meter.

13. The method according to claim 12 wherein a bottom surface of a recess associated with the internal thread on one second rod part is in contact with a stop face of the first end of one first rod part to transfer a shock wave during percussive rock drilling.

14. The method according to claim 10 wherein the weld zones are not heat treated after welding.

15. A drill rod for percussive rock drilling comprising:

a first rod part comprising first and second ends, an inner duct, and an external thread disposed adjacent the first end, wherein the external thread is at least partly hardened by heat treatment; and a second rod part comprising first and second ends, an inner duct, and an internal thread disposed adjacent the first end thereof, wherein the internal thread is at least partly hardened by heat treatment, wherein the second end of the first rod part and the second end of the second rod part are welded together to define a weld zone having a substantially non-annealed martensitic structure, wherein the weld zone has a higher hardness value than a core hardness of the first and second rod parts, and wherein the hardening of the external and internal threads is performed to achieve a hardness in the range of 440 to 750 HV1.

16. The drill rod according to claim 15 wherein axially successive weld zones are spaced apart by at least one meter.

17. The drill rod according to claim 15 wherein the weld zone includes a friction weld.

18. A drill rod for percussive rock drilling comprising:

a first rod part comprising first and second ends, an inner duct, and an external thread disposed adjacent the first end, wherein the external thread is at least partly hardened by heat treatment; and a second rod part comprising first and second ends, an inner duct, and an internal thread disposed adjacent the first end thereof, wherein the internal thread is at least partly hardened by heat treatment; and at least one intermediate hollow rod part;

wherein the second ends of the first and second rod parts are welded to respective ends of the intermediate hollow rod parts to define weld zones having a substantially non-annealed martensitic structure, wherein the weld zone has a higher hardness value than a core hardness of the first and second rod parts, and wherein the hardening of the external and internal threads is performed to achieve a hardness in the range of 440 to 750 HV1.

19. The drill rod according to claim 18 wherein axially successive weld zones are spaced apart by at least one meter.

20. The drill rod according to claim 18 wherein the weld zone includes a friction weld.

* * * * *